United States Patent [19]

Herko

[11] Patent Number: 4,634,374

[45] Date of Patent: Jan. 6, 1987

[54] WINDSCREEN FOR LIGHTER JACKET

[75] Inventor: Robert W. Herko, Harrison, N.Y.

[73] Assignee: Surefire, Inc., New York, N.Y.

[21] Appl. No.: 734,396

[22] Filed: May 15, 1985

[51] Int. Cl.[4] ..... F23Q 25/00

[52] U.S. Cl. ..... 431/146; 431/310

[58] Field of Search..... 431/142, 146, 151, 267, 431/273, 350, 310–314; 131/174, 185; 206/97

[56] References Cited

U.S. PATENT DOCUMENTS

| | | | |
|---|---|---|---|
| 1,800,334 | 4/1931 | Aronson | 431/310 |
| 1,998,339 | 4/1935 | Stansbury | 431/151 |
| 2,505,047 | 4/1950 | Horning | 431/310 |
| 3,521,985 | 7/1970 | Chrisman et al. | 431/151 |
| 4,273,528 | 6/1981 | Gobelt | 431/255 |
| 4,371,331 | 2/1983 | Lee | 431/151 |
| 4,531,906 | 7/1985 | Mizukami | 431/146 |

FOREIGN PATENT DOCUMENTS

| | | | |
|---|---|---|---|
| 383831 | 11/1923 | Fed. Rep. of Germany | 431/146 |
| 652738 | 3/1929 | France | 431/151 |
| 1300281 | 6/1962 | France | 431/142 |
| 87239 | 11/1920 | Switzerland | 431/146 |

*Primary Examiner*—Margaret A. Focarino
*Attorney, Agent, or Firm*—Arthur L. Lessler

[57] ABSTRACT

A jacket for receiving a cigarette lighter has a sliding windscreen which can be slid up from the jacket when the lighter is lit, to shield the lighter flame from the wind. The top of the windscreen has a chimney hole for venting the lighter flame. A cap made of a heat-resistant material is mounted on the top of the windscreen and snap-fit into the chimney hole, to provide an insulating effect so that the finger is not burned when pushing the windscreen down into the jacket after the lighter has been used, and to provide improved finger purchase and feel when pushing down the windscreen. Alternatively, the windscreen is topless and has an outwardly directed peripheral flange for finger purchase with low heat transfer to the finger.

9 Claims, 14 Drawing Figures

WINDSCREEN FOR LIGHTER JACKET

BACKGROUND OF THE INVENTION

This invention relates to a windscreen for a jacket which is adapted to receive a cigarette lighter.

A cigarette lighter jacket is known, which is adapted to receive a cigarette lighter and which has a slidable metal windscreen which can be pushed up with the finger or fingernail to shield the lighter flame from the wind, and thereafter pushed down into the jacket after the lighter has been used.

However, since the windscreen is thermally conductive and is closely adjacent the lighter flame, with the top of the windscreen being heated by the lighter flame, the windscreen rapidly becomes hot, so that the finger is burned when pushing down the windscreen after the lighter has been used.

Accordingly, an object of the present invention is to provide an improved windscreen for a cigarette lighter jacket.

SUMMARY OF THE INVENTION

As herein described, there is provided, in a jacket for receiving a cigarette lighter, a slidable windscreen which can be slid up from the jacket when the lighter is lit, to shield the lighter flame from the wind, and thereafter pushed down into the jacket with the finger, said windscreen comprising: an elongated member having a top surface at an upper end thereof, and a chimney hole in said top surface for venting the lighter flame; and a cap comprising a heat-resistant material mounted on the top surface of said member and having a vent hole, said cap being affixed to said top surface so that at least a part of the vent hole is in alignment with at least a part of the chimney hole, said heat-resistant material providing an insulating effect so that the finger is not burned when pushing the windscreen down into the jacket after the lighter has been used.

According to another aspect of the invention there is provided, in a jacket for receiving a cigarette lighter, a slidable windscreen which can be slid up from the jacket when the lighter is lit, to shield the lighter flame from the wind, and thereafter pushed down into the jacket with the finger, said windscreen comprising an elongated generally trough-shaped member having inner and outer major surfaces, an open top, and an outwardly directed generally U-shaped peripheral flange at an upper end thereof.

IN THE DRAWING

DETAILED DESCRIPTION OF THE PRIOR ART

Figure 1A:
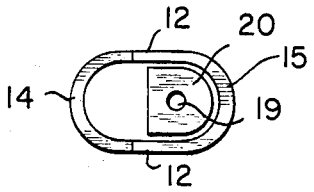
FIG. 1A PRIOR ART
FIG. 1A is a top plan view of a cigarette lighter jacket including a windscreen according to the prior art.
Figure 1D:
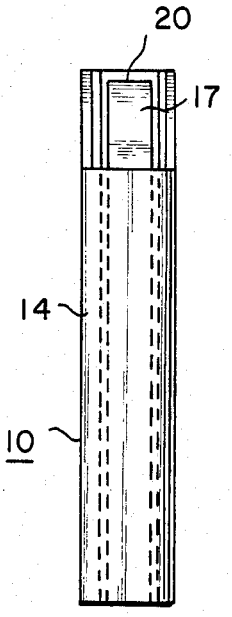
FIG. 1D PRIOR ART
FIG. 1D is a left side view of said lighter jacket.
Figure 1C:
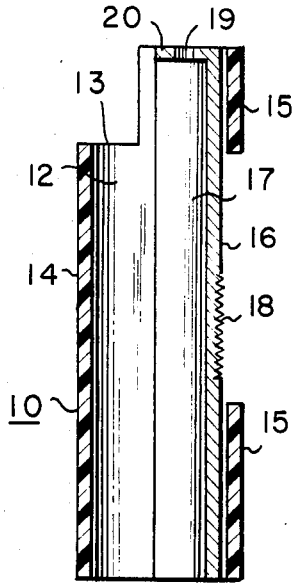
FIG. 1C PRIOR ART
FIG. 1C is a front elevation cross-sectional view of said lighter jacket.
Figure 1E:
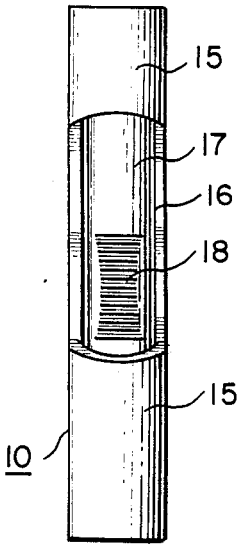
FIG. 1E PRIOR ART
FIG. 1E is a right side view of said lighter jacket.
Figure 1B:
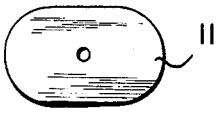
FIG. 1B PRIOR ART
FIG. 1B is a bottom plan view of said lighter jacket.

As shown in FIGS. 1A through 1E, the cigarette lighter jacket 10 comprises a plastic housing which has a generally oval-shaped cross-section with a closed bottom surface 11, an open top region, and slightly curved flat front and rear side walls 12 having stepped portions 13 adjacent the upper end of the jacket.

The left and right side walls 14 and 15 of the jacket 10 are generally semicylindrical or trough-shaped. The right side wall 15 has an elongated opening 16 through which the metal windscreen 17 may be slid up from the jacket 10 by pressing with the finger or fingernail against the transverse serrations 18 on the outer elongated trough-shaped surface of the windscreen 17.

The windscreen 17 is in the shape of an elongated open trough, and has an outer surface which has a generally semicylindrical or other contour similar to that of the inner surface of the right jacket wall 15, so that the outer surface of the windscreen 17 may slide on the inner surface of the wall 15 (and adjacent portions of the inner surfaces of the front and rear walls 12), when a cigarette lighter (not shown) is disposed within the jacket 10 so that the inner surface of the windscreen 17 is adjacent a portion of the outer surface of the cigarette lighter.

The cigarette lighter may be a butane or any other desired type, and is placed in the jacket 10 so that the flame is located below and is vented through a chimney hole 19 in the top surface 20 of the windscreen 17.

When the lighter within the jacket 10 is to be used, the lighter is lit and the windscreen 17 is slid up above the top of the jacket 10 to a desired height, by pressing against the serrations 18, to protect the lighter flame from the wind.

After the lighter has been used and the lighter flame extinguished, the windscreen 17 is returned to its storage position within the jacket 10, by pressing down with the finger on the top surface 20 of the windscreen 17.

However, since the windscreen 17 is made of metal, and is closely adjacent to the lighter flame, the top surface 20 of the windscreen 17 becomes quite hot, so that the finger is burned when pressing the windscreen down.

DETAILED DESCRIPTION OF THE PREFERRED EMBODIMENTS

Figure 2B:
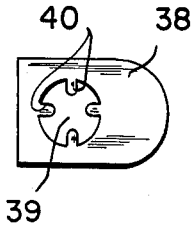
FIG. 2B is a top plan view of said windscreen.
Figure 2A:
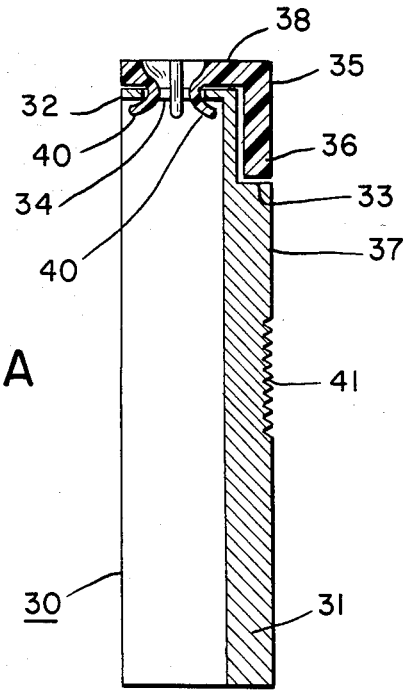
FIG. 2A is a front elevation cross-section view of a windscreen for said lighter jacket, according to a first embodiment of the present invention.

The windscreen 30 shown in FIG. 2A comprises a generally semi-cylindrical or trough-shaped elongated metal member 31 having a top surface 32 at an upper end thereof, and an indented shoulder portion 33 adjacent said upper end. The top surface 32 has a chimney hole 34 therein.

A cap 35 rests atop the member 31, with a generally trough-shaped base portion 36 of the cap resting on the shoulder portion 33 of the member 31 in such a manner that the outer surface of the base portion 33 is substantially coextensive with the adjacent portion 37 of the outer surface of the member 31.

The cap 35 comprises a heat resistant material such as Teflon (polytetrafluoroethylene), a thermosetting plastic such as Bakelite, silicone plastics, fiberglass, asbestos or any other suitable material, Bakelite being preferred.

The top surface 38 of the cap 35 has a vent hole 39 into and below which four prongs 40 extend. The prongs 40 are formed integrally with the cap 35, and are preferably resilient, so that they allow the cap to be snap-fit to the member 31 by pressing the top surface 38 of the cap 35 against the top surface 32 of the member 31 to cause the prongs 40 to extend into the chimney hole 34 and spring outward to hold the cap 35 against the top surface 32.

Alternatively, the prongs 40 may comprise a bendable non-resilient material and the cap 35 may be held in position on the member 31 by bending the prongs outward after they have been extended through the chimney hole 34.

The cap 35 is installed on the top surface 32 of the member 31 so that at least a portion of the vent hole 39 is aligned with at least a portion of the chimney hole 34, to permit venting of the lighter flame.

The windscreen 30 has serrations 41 for enabling it to be raised when the windscreen is substituted for the windscreen 17 disposed within the jacket 10 shown in FIGS. 1A through 1E.

The windscreen 30, when disposed in the jacket 10, is utilized is essentially the same manner as the windscreen 17 which it replaces. However, the insulating effect of the cap 35 prevents burning or discomfort when the finger is pressed on the top surface 38 of the cap 35 to push the windscreen 30 down into the jacket 10 after the lighter has been used.

Figure 3:
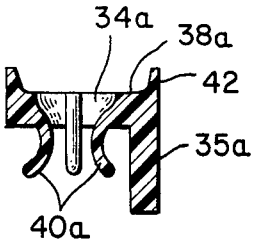
FIG. 3 is a front elevation cross-sectional view of a windscreen cap according to a second embodiment of the invention.

FIG. 3 shows a modified form **35*a* of the cap 35 according to a second embodiment of the invention, for use on the member 31, in which those portions which perform a function similar to corresponding portions of the cap 35**, are given the same numbers followed by "a".

In the modified cap **35*a* of FIG. 3, the top surface 38*a* has a raised peripheral lip 42 which provides additional insulation thickness of the cap as well as improved purchase and feel for the finger when pushing the windscreen down by pressing on the crater-shaped top surface 38*a***.

Figure 2C:
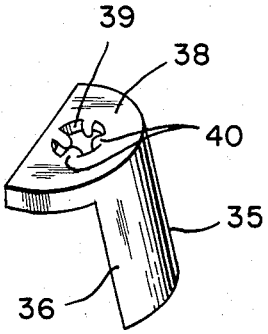
FIG. 2C is a perspective view of the cap of said windscreen.
Figure 4A:
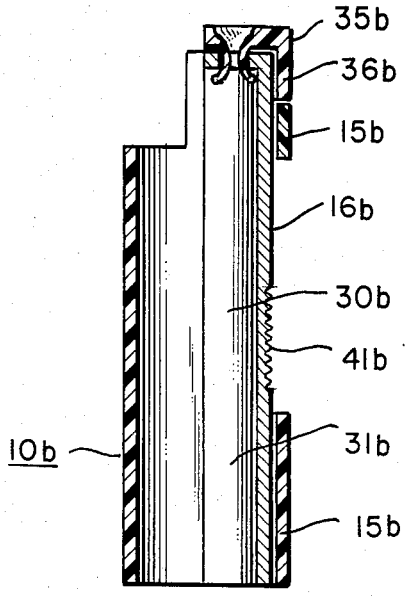
FIG. 4A is a front elevation cross-sectional view of a lighter jacket and windscreen according to a third embodiment of the invention.
Figure 4B:
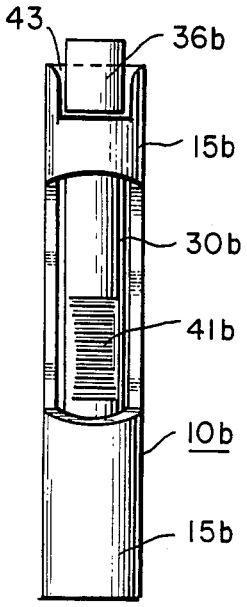
FIG. 4B is a side view of the lighter jacket and windscreen shown in FIG. 4A.

FIGS. 4A and 4B show a modified form **10*b* of the jacket 10 of FIGS. 1A through 1E, and a modified form 30*b* of the windscreen 30 of FIGS. 2A through 2C, according to a third embodiment of the invention. Those portions of the jacket 10*b* and windscreen 30*b* which perform a function similar to corresponding portions of the jacket 10 and windscreen 30** respectively, are given the same numbers followed by "b".

In the windscreen **30*b*, the member 31*b* does not have an indented upper shoulder portion. Rather, the base portion 36*b* of the cap 35*b* protrudes from the outer surface of the member 31*b*. The right side wall 15*b* of the jacket 10*b* has a recess 43 in the upper end thereof for receiving the cap base portion 36*b***.

Figure 5:
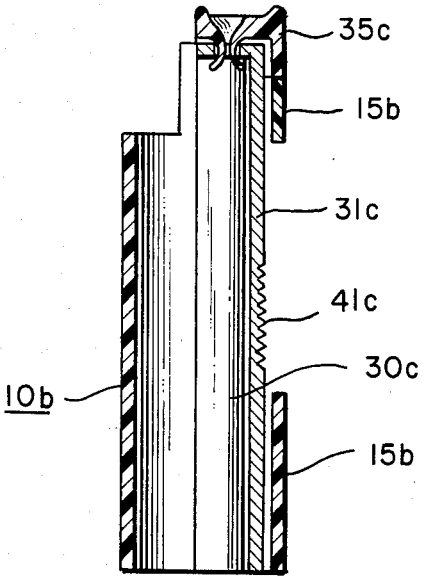
FIG. 5 is a front elevation cross-sectional view of the lighter jacket of FIGS. 4A and 4B with a windscreen according to a fourth embodiment of the invention.

In the fourth embodiment of the invention shown in FIG. 5, the windscreen **30*c* is generally similar to the windscreen 30*b* of FIGS. 4A and 4B, except that the cap 35*c* has a raised peripheral lip similar to that of the cap 35*a***.

Figure 6A:
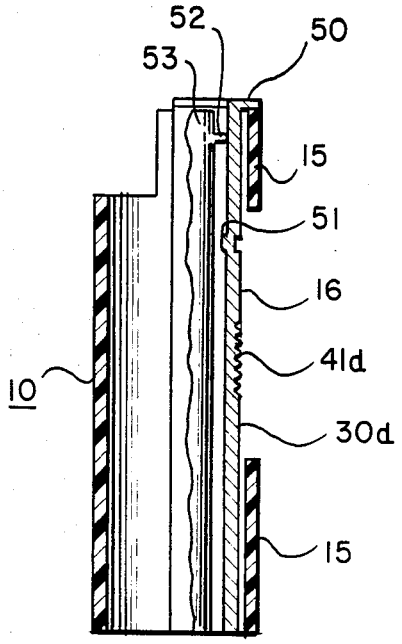
FIG. 6A is a front elevation cross-sectional view of the lighter jacket shown in FIGS. 1A through 1E with a windscreen according to a fifth embodiment of the invention.
Figure 6B:
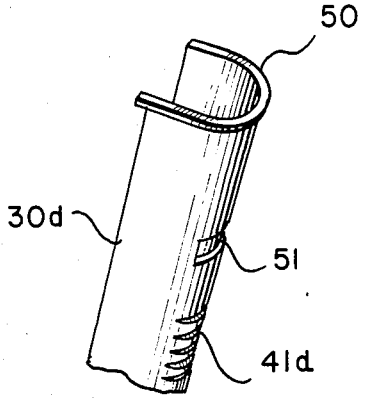
FIG. 6B is a perspective view of the upper portion of the windscreen shown in FIG. 6A.

In the fifth embodiment of the invention shown in FIGS. 6A and 6B, a windscreen **30*d* is employed which can be used without any modification of the prior art lighter jacket 10 shown in FIGS. 1A through 1E. The windscreen 30*d* is topless; that is, it does not have the top 20 of the prior art windscreen or of the other windscreens shown in FIGS. 2A, 4A and 5**.

By eliminating the windscreen top surface 20, which is in the path of and therefore directly heated by the lighter flame, the temperature at the upper end of the windscreen **30*d*** is reduced.

An outwardly directed generally U-shaped peripheral flange 50 is provided at the upper end of the windscreen **30*d* in order to (i) provide finger purchase for pushing the windscreen down into the lighter jacket 10**, (ii) provide a contact area for the finger which is out of the path of the lighter flame so that heat transfer to the finger is reduced, and (iii) provide a shoulder for engaging the upper end of the lighter jacket to restrict downward movement of the windscreen into the lighter jacket.

The windscreen **30*d* has, adjacent the upper end thereof, an inwardly protruding lateral ridge 51 which is adapted to engage the lower surface of the flame control 52 of a lighter 53 disposed within the jacket 10, to prevent further upward movement of the windscreen. This ridge insures that the windscreen cannot be inadvertently removed from the lighter jacket, a problem which can occur with the prior art windscreen 17 shown in FIGS. 1A through 1E. A similar inwardly directed lateral ridge can be provided in each of the windscreens 30, 30*b* and 30*c***.

The lateral serrations **41*d* of the windscreen 30*d* are disposed below the ridge 51, and permit the windscreen to be raised above the upper end of the lighter jacket 10 by a predetermined amount limited by engagement of the upper surface of the ridge 51 with the lower surface of the flame control 52**.

I claim:

1. In a jacket for receiving a cigarette lighter, a slidable windscreen which can be slid up from the jacket when the lighter is lit, to shield the lighter flame from the wind, and thereafter pushed down into the jacket with the finger, said windscreen comprising:

an elongated generally trough-shaped member having a top surface at an upper end thereof, and a chimney hole in said top surface for venting the lighter flame; and a cap comprising a heat-resistant material mounted on the top surface of said member and having a vent hole with a plurality of prongs extending into the vent hole and snap-fit into the chimney hole so that at least a part of the vent hole is in alignment with at least a part of the chimney hole, said heat-resistant material providing an insulating effect so that the finger is not burned when pushing the windscreen down into the jacket after the lighter has been used.

2. The windscreen according to claim 1, wherein said trough-shaped member has an indented shoulder portion adjacent said top surface thereof, and said cap has a trough-shaped base portion disposed in said indented shoulder portion so that the outer surface of the base portion of the cap is substantially coextensive with the adjacent portion of the outer surface of said trough-shaped member.

3. The windscreen according to claim 1, wherein said heat resistant material is a thermosetting plastic comprising Bakelite.

4. The windscreen according to claim 1, wherein said cap has a top surface with a raised peripheral lip surrounding said vent hole.

5. The windscreen according to claim 1, wherein said cap has a trough-shaped base portion partially surrounding and protruding outwardly from an upper portion of said trough-shaped member adjacent said upper end thereof, said jacket having a recess for receiving said protruding base portion of said cap.

6. In a jacket for receiving a cigarette lighter, a slidable windscreen which can be slid up from the jacket when the lighter is lit, to shield the lighter flame from the wind, and thereafter pushed down into the jacket with the finger, said windscreen comprising:

an elongated generally trough-shaped member having a top surface at an upper end thereof, and a chimney hole in said top surface for venting the lighter flame; and a cap comprising a heat-resistant material mounted on the top surface of said member and having a vent hole with a plurality of prongs extending into the vent hole and snap-fit into the chimney hole so that at least a part of the vent hole is in alignment with at least a part of the chimney hole, said cap having a top surface and a base portion, said top surface having a raised peripheral lip surrounding said vent hole, said base portion partially surrounding and protruding outwardly from an upper portion of said trough-shaped member adjacent said upper end thereof, said jacket having a recess for receiving said protruding base portion of said cap;

said heat-resistant material providing an insulating effect so that the finger is not burned when pushing the windscreen down into the jacket after the lighter has been used.

7. The windscreen according to claim 1 or 6, further comprising an inwardly extending lateral ridge adapted to engage a portion of any lighter within said jacket adjacent the inner surface of the windscreen, when said windscreen is slid up a predetermined distance from the jacket, to prevent further upward movement of the windscreen.

8. The windscreen according to claim 7, further comprising a series of lateral serrations in the outer surface of the windscreen, said serrations being disposed below said ridge.

9. In a jacket for receiving a cigarette lighter, said jacket having an open top region and a side wall having an upper edge adjacent said top region, a slidable windscreen which can be slid up from within the jacket when the lighter is lit, to shield the lighter flame from the wind, and thereafter pushed down into the jacket with the finger, said windscreen comprising:

a topless elongated generally trough-shaped member having inner and outer major surfaces, and an outwardly directed generally U-shaped peripheral flange at an upper end thereof, said flange providing finger purchase for facilitating the pushing of the windscreen down into the lighter jacket, said flange providing a shoulder for engaging said upper edge of said lighter jacket to restrict downward movement of the windscreen into the lighter jacket;

an inwardly extending lateral ridge adapted to engage a portion of any lighter within said jacket adjacent the inner surface of the windscreen, when said windscreen is slid up a predetermined distance from the jacket, to prevent further upward movement of the windscreen; and a series of lateral serrations in the outer surface of the windscreen, said serrations being disposed below said ridge.

* * * * *